US011473759B1

(12) United States Patent
Huang

(10) Patent No.: US 11,473,759 B1
(45) Date of Patent: Oct. 18, 2022

(54) ADAPTING TYPE OF OPTICAL ELEMENT IN A SHELL-LIKE ACCESSORY

(71) Applicant: Chi-Ping Huang, Taipei (TW)

(72) Inventor: Chi-Ping Huang, Taipei (TW)

( * ) Notice: Subject to any disclaimer, the term of this patent is extended or adjusted under 35 U.S.C. 154(b) by 0 days.

(21) Appl. No.: 17/372,004

(22) Filed: Jul. 9, 2021

(51) Int. Cl.

| | |
|---|---|
| ***F21V 3/02*** | (2006.01) |
| ***F21V 19/00*** | (2006.01) |
| ***A47G 33/00*** | (2006.01) |
| *F21Y 115/30* | (2016.01) |

(52) U.S. Cl.
CPC ..... *F21V 19/0015* (2013.01); *A47G 33/00* (2013.01); *F21V 3/023* (2013.01); *F21V 3/026* (2013.01); *F21Y 2115/30* (2016.08)

(58) Field of Classification Search
CPC ..... F21V 3/023; F21V 3/026; F21V 19/0015
USPC ..... 362/808
See application file for complete search history.

(56) References Cited

U.S. PATENT DOCUMENTS 5,534,315 A * 7/1996 Witte ..... B44C 5/00 40/550
9,463,582 B2 10/2016 Huang

* cited by examiner

*Primary Examiner* — Sean P Gramling
(74) *Attorney, Agent, or Firm* — Muncy, Geissler, Olds & Lowe, P.C.

(57) ABSTRACT

An adapting type of optical element in a shell-like accessory is disclosed. For a shell-like accessory formed by gluing fiber threads, an illuminating area is planned on the surface of shell-like accessory to develop lumen by combining laser elements to the illuminating area. The combination is implemented by adapting a transfer unit with a pitched fin to form a transient pinching. The transfer unit is implanted in advance in an implant area of the illuminating area. During implantation and combination, by the pinching and supporting of the pitched fins of the transfer units, angles of center lines of the transfer units can be adjusted, so that accurate projected angles of light beams from the post-adapted laser elements can be achieved.

12 Claims, 11 Drawing Sheets

ADAPTING TYPE OF OPTICAL ELEMENT IN A SHELL-LIKE ACCESSORY

BACKGROUND OF THE INVENTION a) Field of the Invention

The present invention relates to an adapting type of optical element in a shell-like accessory, and more particularly to an adapting type which provides for a light emitting area in a large doll, so that projected angles of light beams from laser elements can be accurate by adapting transfer units, of which the angles are pre-adjusted, to the laser elements.

b) Description of the Prior Art

For a shell-like accessory 10, such as a giant accessory put up in a festival like Christmas, if it is about the same height as a person, then fiber sheets should be glued by hand in manufacturing to form a housing 11, thereby perfecting into the shell-like accessory 10. In order to allow the accessory to manifest a beautification effect under a low background light or during night, plural laser elements 30 are distributed on a selected illuminating area 20, so that by the photoelectric effect of the laser elements 30, the object of beautifying the accessory can be achieved. As shown in FIG. 1, the shell-like accessory 10 is a three-dimensional doll, and an illuminating area 20 is planned on the chest. The illuminating area 20 is distributed with plural laser elements 30 to generate light beams Bo, and a ray Bn which is accumulated by plural light beams Bo emits outward. Therefore, a bright lumen will happen in the illuminating area 20 to achieve the effect of light decorating or the function of shining. The intensity of lumen can be changed by adjusting the power of laser elements 30, and the color can be even changed by adjusting the wavelengths of the laser elements 30.

Referring to FIG. 2, an implant area 21 combining optical elements is defined on the illuminating area 20 of the housing 11. As the housing 11 is formed by gluing the fiber sheets, in the process of coating and stacking, as the coating force and the gaps among the fibers are not uniform, the adhesive agent will not be contracted uniformly during solidification, which deforms an expected structure surface P corresponding to the implant area 21. Accordingly, the projected angles of operating light beams will be uncontrolled, and the lumen inside the illuminating area 20 will not be uniform.

For a similar approach, the present inventor has already filed a patent application Ser. No. 14/543,609 to the US Patent Office on Nov. 17, 2014. However, the operating angles of the light beams Bo cannot be controlled directly.

As shown in FIG. 3 (along with FIG. 1), the implant area 21 can be an independent unit assembled on the housing 11 or can be extended directly from the housing 11. As the shell-like accessory 10 is large, in order to match the implant area 21 to the entire appearance of the shell-like accessory 10, it is often seen that the implant area 21 is directly planned on the housing 11, and the implant area 21 is combined with the laser elements 30 for the effect of light decoration. A conventional means is to use a hub 40, and the laser elements 30 are embedded in during the process of forming the housing 11. Especially, a radial outer surface 42 is combined with the housing 11, with that a receiving opening 41 provides for latching in the laser element 30 after solidification. A base portion 31 of the laser element 30 is then latched into the receiving opening 41. As plural radial outer surfaces 42 face outward, the center lines S thereof will be offsetting with respect to one another following the curve change on the surface of implant area 21. Therefore, due to the deformation of expected structure surface P and the factor that the lumen is inversely proportional to the square of distance, a non-uniform change in brightness will be formed on a light emitting layer in an optical plane Ly, due to the non-uniformity in the radiation angle of light from each laser element 30, thereby affecting the beauty of uniformity visually.

SUMMARY OF THE INVENTION

A primary object of the present invention is to provide an adapting type of optical element for a shell-like accessory. A shell-like accessory such as a large doll in Christmas is formed by gluing fiber threads, and a surface of the accessory is planned with an illuminating area to radiate lumen. The illuminating area is provided with plural transfer units which are pinched transiently. In the process of implanting and combining, by the support of the transfer units, angles of center lines of the transfer units can be adjusted accurately in advance, so that the operating light beams from the adapted laser elements can be parallel to one another.

A second object of the present invention is to provide an adapting type of optical element for a shell-like accessory, wherein a root portion of the laser element is radially provided with an off-center wedge, a bottom of an embedding slot provided by the transfer unit is provided correspondingly with a concentric opening to transfix the off-center wedge, and a pinch plate to pinch the off-center wedge, so that the transfer unit and the laser element can be combined in dry, and the laser element can be replaced easily.

A third object of the present invention is to provide an adapting type of optical element for a shell-like accessory, wherein an adhesive tank is disposed in a space between two pitched fins on a surface of a barrel unit, acting as a space to store an adhesive agent for gluing.

A fourth object of the present invention is to provide an adapting type of optical element for a shell-like accessory, wherein the transfer unit is formed by hot-work molding to a plastic material. The structure of the provided pitched fin depends upon the plastic material, and the structural strength can be larger than or smaller than the tissue strength of the implant area, so that when the transfer unit is assembled with a drilled hole of the illuminating area, the stress of thrusting can be absorbed by the change in hardness. In addition, the elastic pinching effect can be achieved by the elastic deformation, thereby assisting the positioning of angles and stabilizing the combination.

A fifth object of the present invention is to provide an adapting type of optical element for a shell-like accessory, wherein the drilled holes are distributed in an array, and the pitches of drilled holes are equal or change in a geometric series. In addition, the array can be arranged in a matrix.

A sixth object of the present invention is to provide an adapting type of optical element for a shell-like accessory, wherein the pitched fin is a rib, and its cross section is a triangle, square or any geometric shape. At least a side of the pitched fin is a thigh edge which is combined with the barrel unit, and the other side is a hook edge which is combined with a corner end surface.

A seventh object of the present invention is to provide an adapting type of optical element for a shell-like accessory, wherein the connection location between the pitched fin and the corner end surface is opened with a stress notch. By the stress notch, the effect of deformation in the pitched fin to the corner end surface can be absorbed. In addition, after assembling, the corner end surface of a hub can be attached flat on a rim of the drilled hole.

An eighth object of the present invention is to provide an adapting type of optical element for a shell-like accessory, wherein the stress notch that is opened on the upper end of the pitched fin is provided with an oblique end edge which tilts upward, so that after a thin shell unit is transfixed and combined, the positioning and combining ability can be assisted by an oblique shear stress of the oblique end edge.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

The present invention discloses an adapting type of optical element in a shell-like accessory. For a shell-like accessory formed by gluing fiber threads, in an illuminating area planned on a surface of the shell-like accessory, laser elements in accurate or corrected angles are fixed and combined through plural transfer units. This allows operating angles of light beams emitted by the post-loaded laser elements to be accurate, so as to satisfy an expected condition, such as that plural light beams are parallel to one another. In addition, by adapting plural transfer units to an implant area of the illuminating area, a barrel unit provided by each transfer unit can be defined as that a center line thereof faces toward a same direction and is parallel. Therefore, after emplacing the laser element, the operating angle of light beam generated from the laser element can be arranged accurately, like parallel to each other. Accordingly, a uniform light emitting effect from a planar light emitting layer can be formed visually on an exterior side of the illuminating area.

Figure 1:
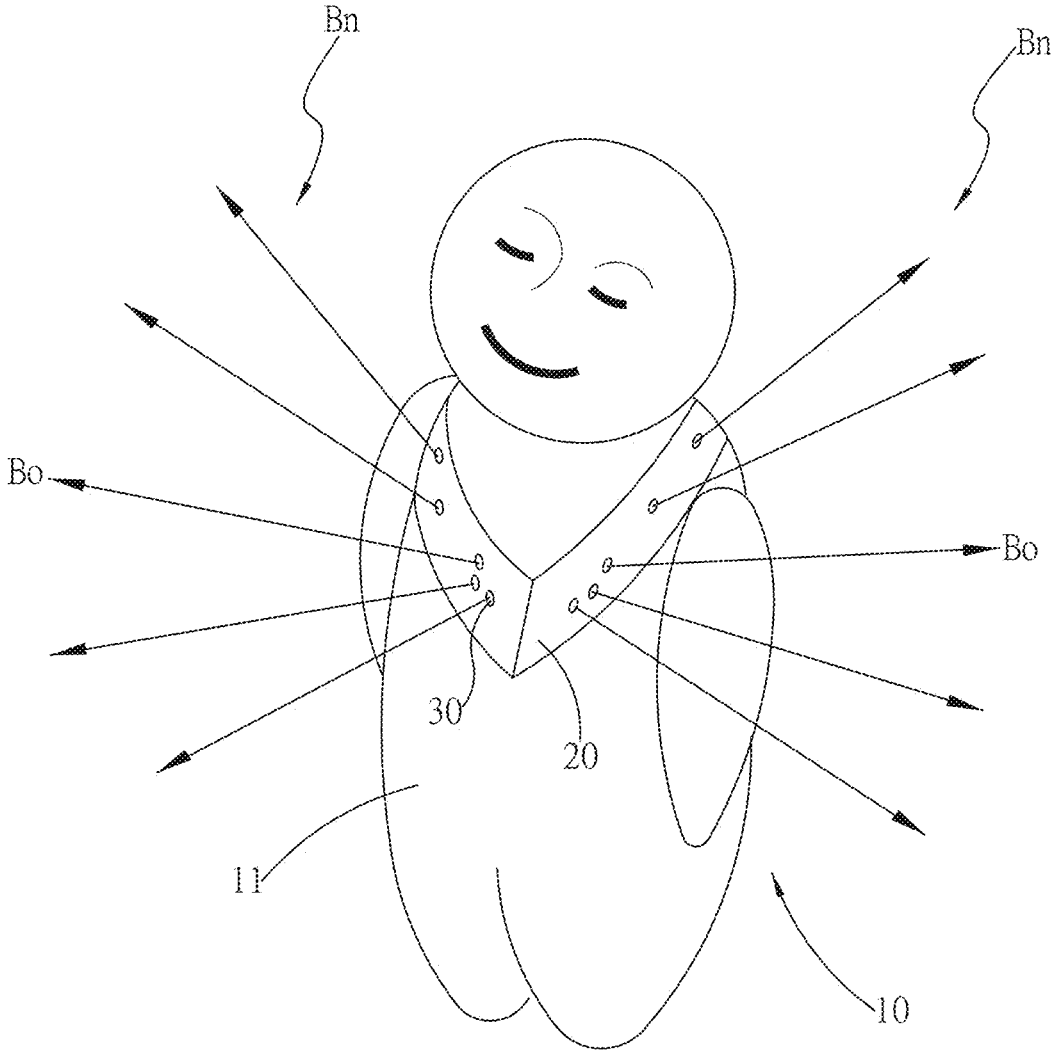
FIG.1 Prior Art
FIG. 1 shows a three-dimensional view of a conventional shell-like accessory.
Figure 2:
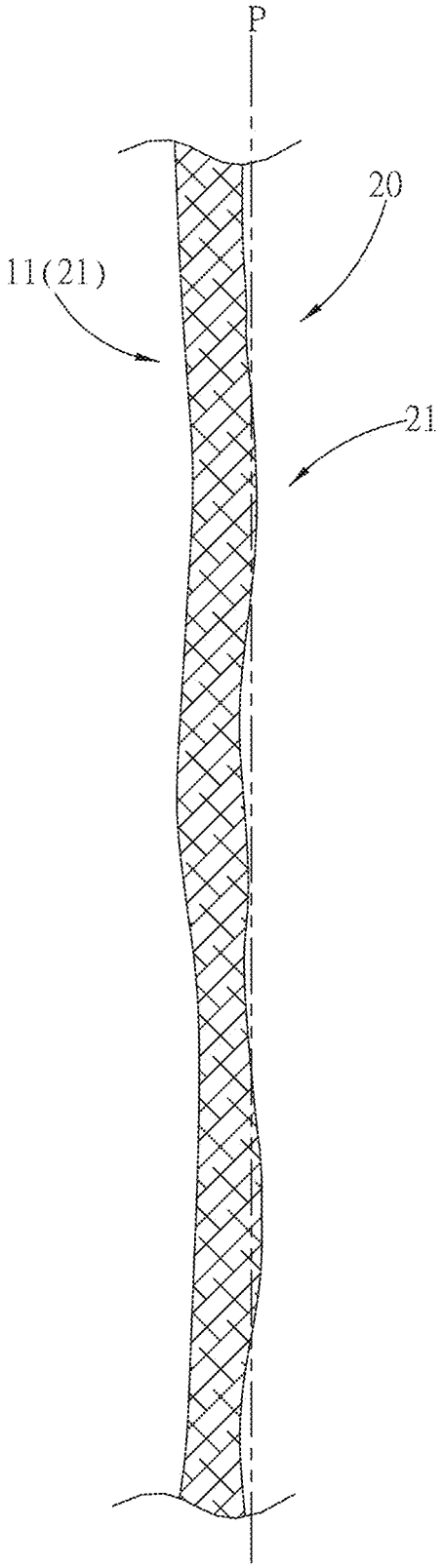
FIG.2 Prior Art
FIG. 2 shows a schematic view of deformation on a surface of housing of the conventional shell-like accessory.
Figure 3:
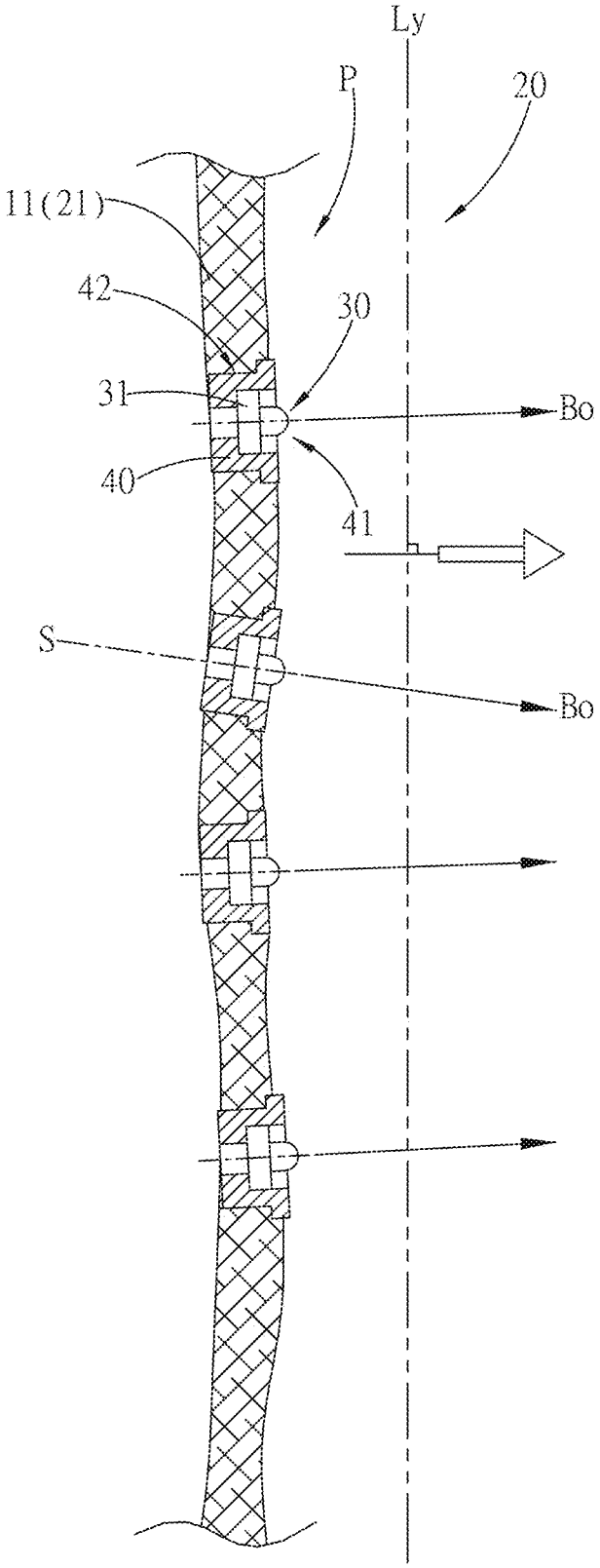
FIG.3 Prior Art
FIG. 3 shows a side view of state that the conventional housing is combined with laser elements.
Figure 4:
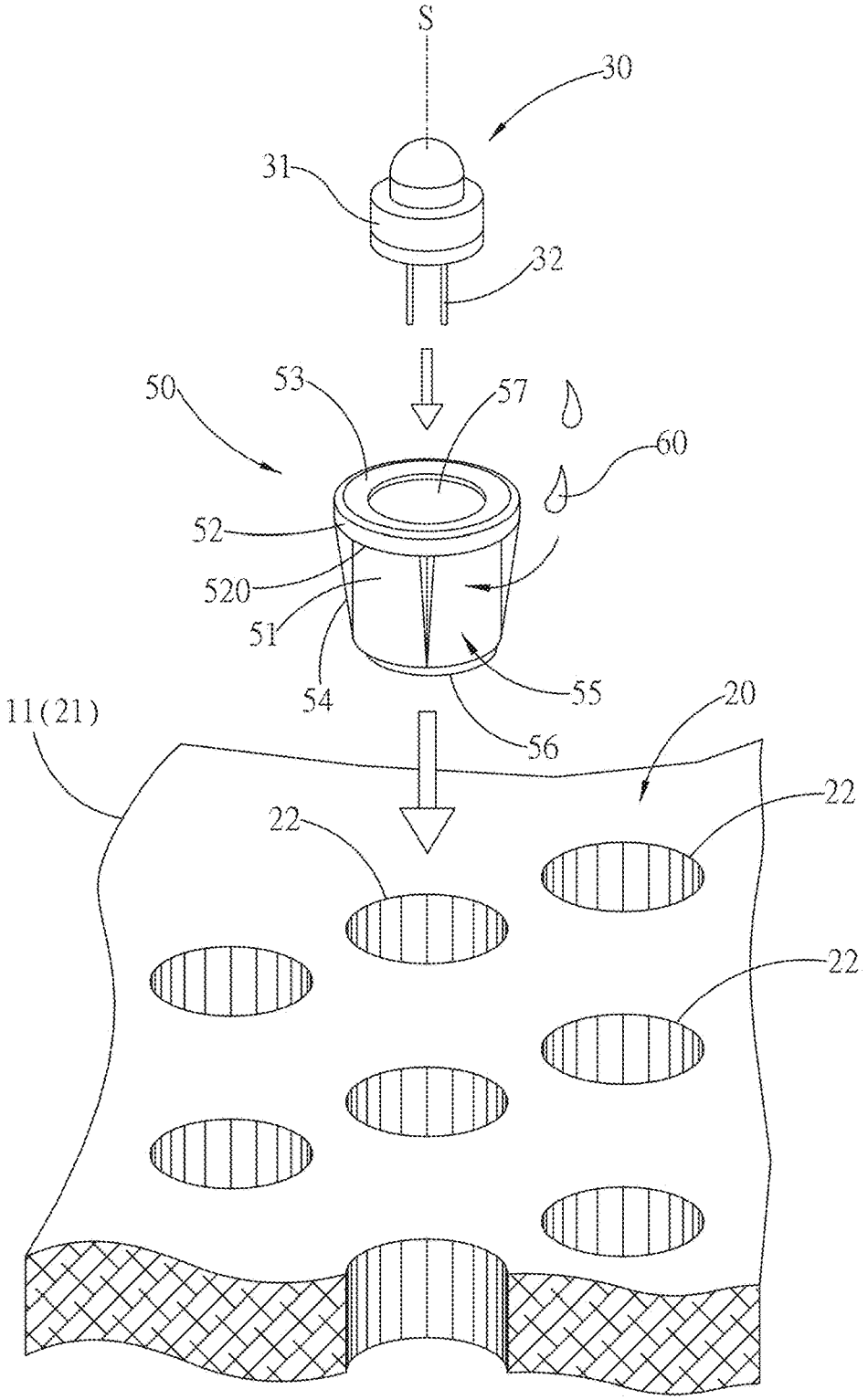
FIG. 4 shows a schematic view of combination among structures, according to the present invention.

Referring to FIG. 4 for the detailed structures and state of implementation of the present invention, an implant area 21 is defined on a surface of housing 11 by extending directly from the housing 11 or by adding extra. The surface of implant area 21 is distributed in an array with plural drilled holes 22, and each drilled hole 22 provides for combining a corresponding transfer unit 50. After combining, the transfer unit 50 provides for assembling with a corresponding laser element 30.

It is preferred that the transfer unit 50 is formed by hot-work molding to a plastic material. The transfer unit 50 is in a shape of a barrel and is provided integrally with a center line S. A barrel unit 51 is formed by rotating conjugably against the center line S, a lower end of the barrel unit 51 is a root portion 56, and an upper end of the barrel unit 51 is expanded with a ring spoke 52. An upper surface of the ring spoke 52 is an isometric torus 53, the isometric torus 53 is in a shape of ring, and a center opening thereof is connected to an embedding slot 57. The embedding slot 57 provides for emplacing the laser element 30 in a smaller diameter. The laser element 30 is provided with a base portion 31, and kinetic friction is formed between the base portion 31 and the embedding slot 57. Therefore, an optical axis formed by the laser element 30 will be superimposed on the center line S. After assembling with an input terminal 32 of the laser element 30, the input terminal 32 will penetrate downward the root portion 56 to connect an internal electric unit (not shown in the drawing).

As the ring spoke 52 is expanded, a drop is formed between the ring spoke 52 and the barrel unit 51. The drop forms a corner end surface 520. An outer surface of the barrel unit 51 is distributed radially at least with three longitudinal pitched fins 54 against the center line S. A side of the pitched fin 54 is pitched, a thigh edge thereof is combined with the barrel unit 51, a hook edge thereof is combined with the corner end surface 520, and a chord edge thereof is formed by extending linearly an outer circumference of the ring spoke 52 toward the root portion 56. The joint angle between the corner end surface 520 and the barrel unit 51 can be 90 degrees.

A radially indented space is formed between two pitched fins 54, and the indented space forms an adhesive tank 55.

The diameter of the barrel unit 51 is smaller than that of the drilled hole 22 in the implant area 21, and the diameter of the ring spoke 52 is larger than that of the drilled hole 22 in the implant area 21. The drop between the two is absorbed by a hypotenuse (chord edge) of the pitched fin 54. On the other hand, the pitched fin 54 is a rib with a pitched end, and its transversal cross section is a triangle.

Figure 5:
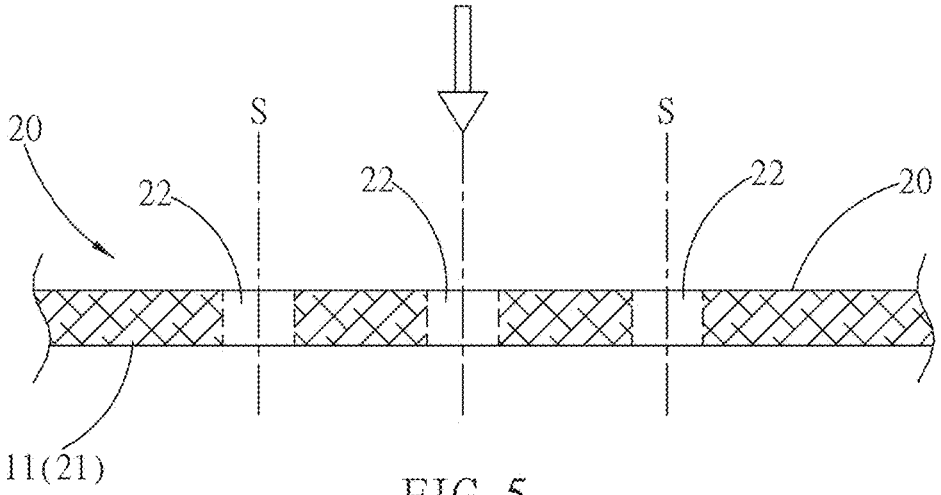
FIG. 5 shows a side cutaway view that an implant area is opened with drilled holes, according to the present invention.

Referring to FIG. 5, a surface of the implant area 21 in an illuminating area 20 is selected as an application of the present invention. Firstly, plural drilled holes 22 are opened parallel, and the center lines S of plural drilled holes 22, which are distributed in an array, are parallel to one another. In addition, for the gradual change on a glossy face of the illuminating area 20, the pitches of drilled holes 22 can be set up to change in a geometric series toward a direction, so that the lumen in the illuminating area 20 can be darker on the periphery and brighter toward the center.

Figure 6:
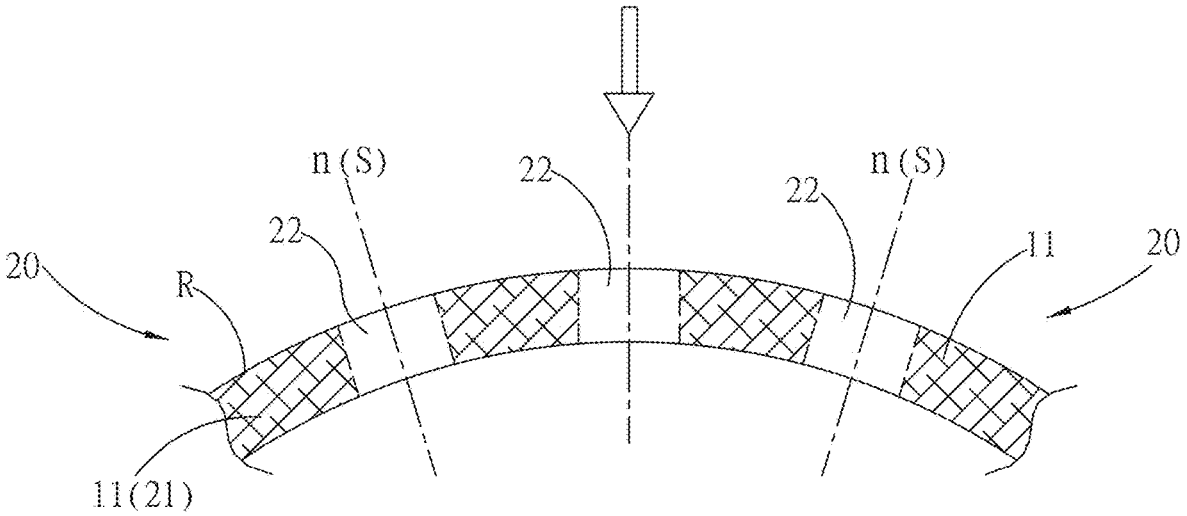
FIG. 6 shows a side cutaway view that a surface of the curved implant area is opened with the drilled holes, according to the present invention.

Referring to FIG. 6, if the surface of the selected implant area 21 in the illuminating area 20 is curved, then the drilled holes 22 that are opened are disposed against the center line S based upon a normal n on a curvature R thereof for the location thereof; that is, the center line S of each drilled hole 22 is superimposed on the normal n.

Figure 7:
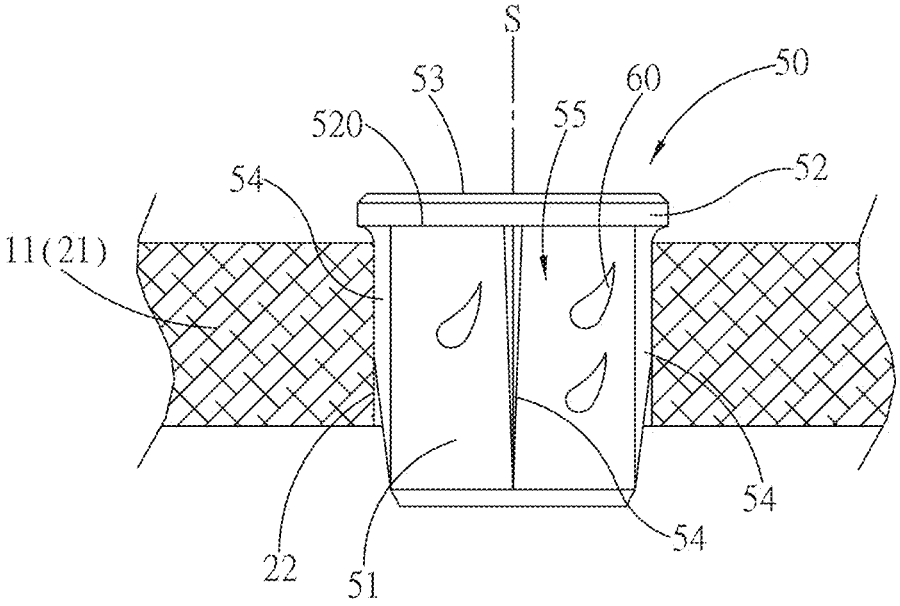
FIG. 7 shows a side cutaway view that transfer units are combined to the drilled holes, according to the present invention.

Referring to FIG. 7 (along with FIG. 8), for combining the transfer unit 50 with the drilled hole 22, the root portion 56 of the transfer unit 50 is transfixed into the drilled hole 22 from the implant area 21. In the process, if the structural strength of the disposed pitched fin 54 is smaller than the tissue strength of the implant area 21, collapse and deformation will be formed. The location of the smallest deformation of the pitched fin 54 is close to the corner end surface 520 above the ring spoke 52. This location is the maximum limit for latching the transfer unit 50 into the drilled hole 22 (reasonable application of a force to system combination).

If the strength of the pitched fin 54 is larger than that of the drilled hole 22, then as the hypotenuse thereof will cut an inner circumference at an upper corner of the drilled hole 22, before assembling the transfer unit 50 or before and after thrusting the transfer unit 50 into the drilled hole 22, the space of adhesive tank 55 can be filled with adhesive agent 60, so that the external surface of the barrel unit 51 can be glued and fixed with the inner circumference of the drilled hole 22.

Figure 9:
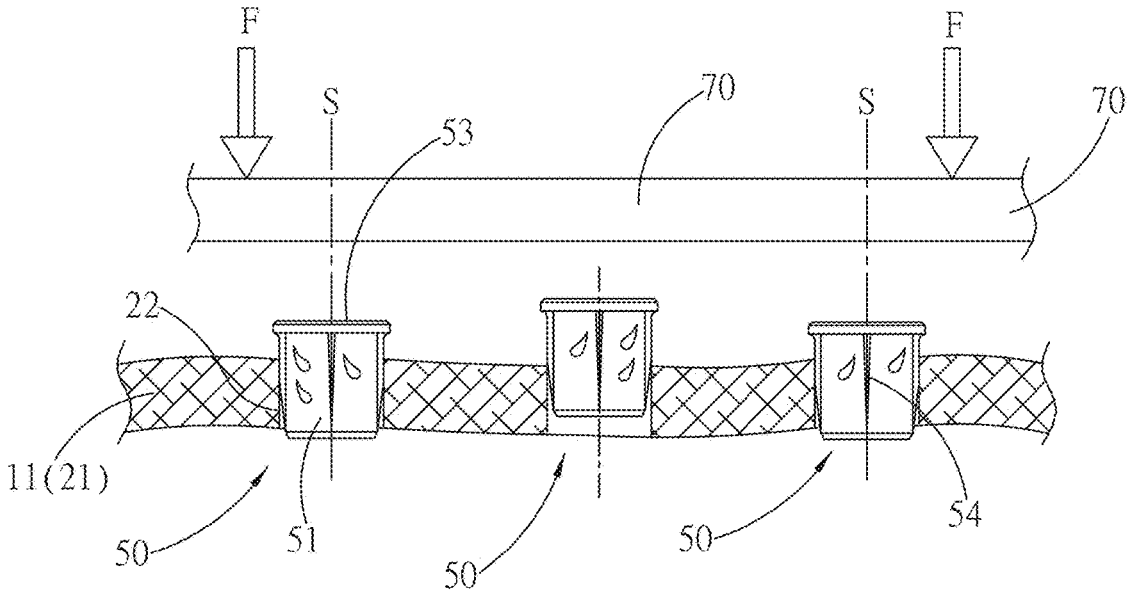
FIG. 9 shows a schematic view that plural transfer units are squeezed flat by a plate gauge, according to the present invention.

Referring to FIG. 9, when the transfer units 50 are assembled with the corresponding drilled holes 22 in the implant area 21, the center line S of each drilled hole 22 is basically parallel to each other, the pitched fin 54 of the transfer unit 50 is radially distributed at an equal angle, and each pitched fin 54 is the same in shape. After thrusting the transfer unit 50 into the drilled hole 22, the center line S thereof will be also superimposed on the center line S of the drilled hole 22. At this moment, if the pinch intensity between the pitched fin 54 and the drilled hole 22 is sufficient, then the transfer unit 50 and the drilled hole 22 can be combined in dry. In the meantime, by the drop between the barrel unit 51 and the inner circumference of the drilled hole 22, the center line S of the transfer unit 50 can be adjusted again.

Figure 8:
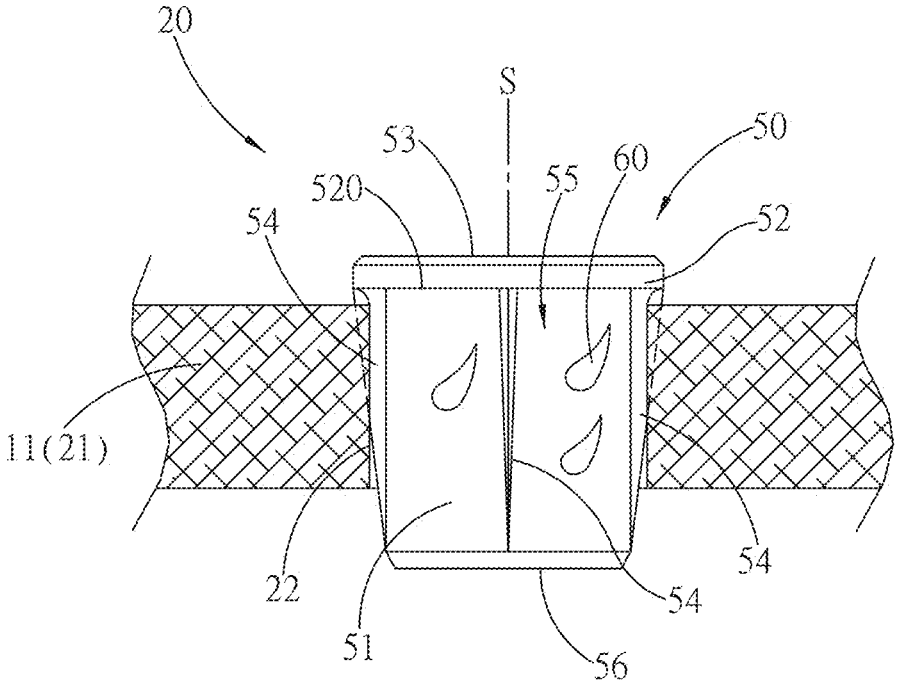
FIG. 8 shows another side cutaway view that the transfer units are combined to the drilled holes, according to the present invention.

As shown in FIG. 7 and FIG. 8, the space of the adhesive tank 55 is filled with the adhesive agent 60, and in the process of solidification when the adhesive agent 60 is not dry, the center line S of the transfer unit 50 can be still adjusted.

Figure 10:
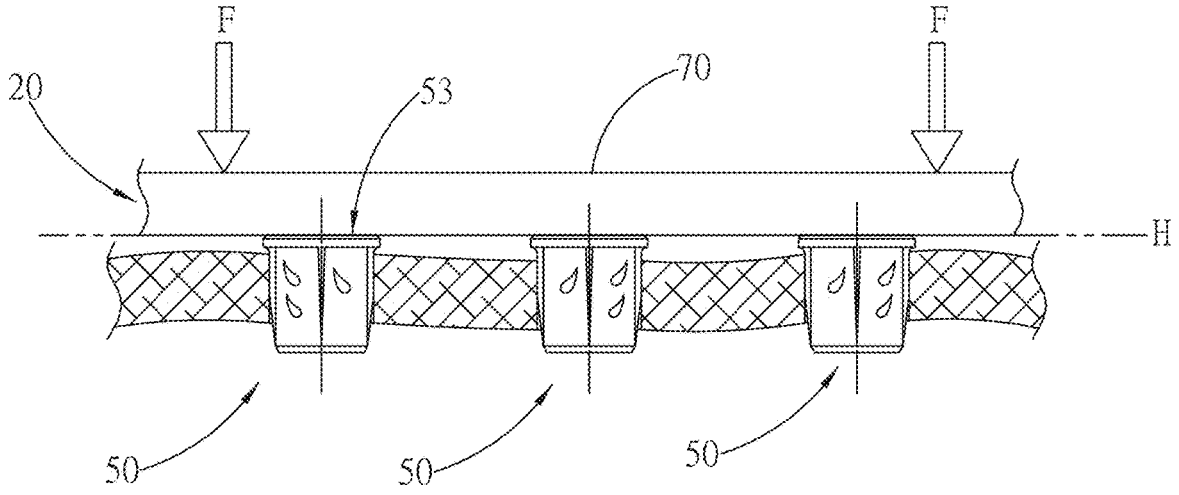
FIG. 10 shows another schematic view that plural transfer units are squeezed flat by the plate gauge, according to the present invention.

Referring to FIG. 10, in the process of assembling the transfer unit 50, the isometric torus 53 of each transfer unit 50 can be simultaneously pressed into a constant-height surface under the aiding of a plate gauge 70. The means uses a lower surface of the plate gauge 70 as a flat plane which presses down the isometric torus 53 of each transfer unit 50 by a suppression force F simultaneously. After releasing the suppression force F, each isometric torus 53 will be located at a height of same constant-height surface H. Therefore, the light emitting layer generated from the illuminating area 20 will be more uniform as the light source points are even.

Figure 11:
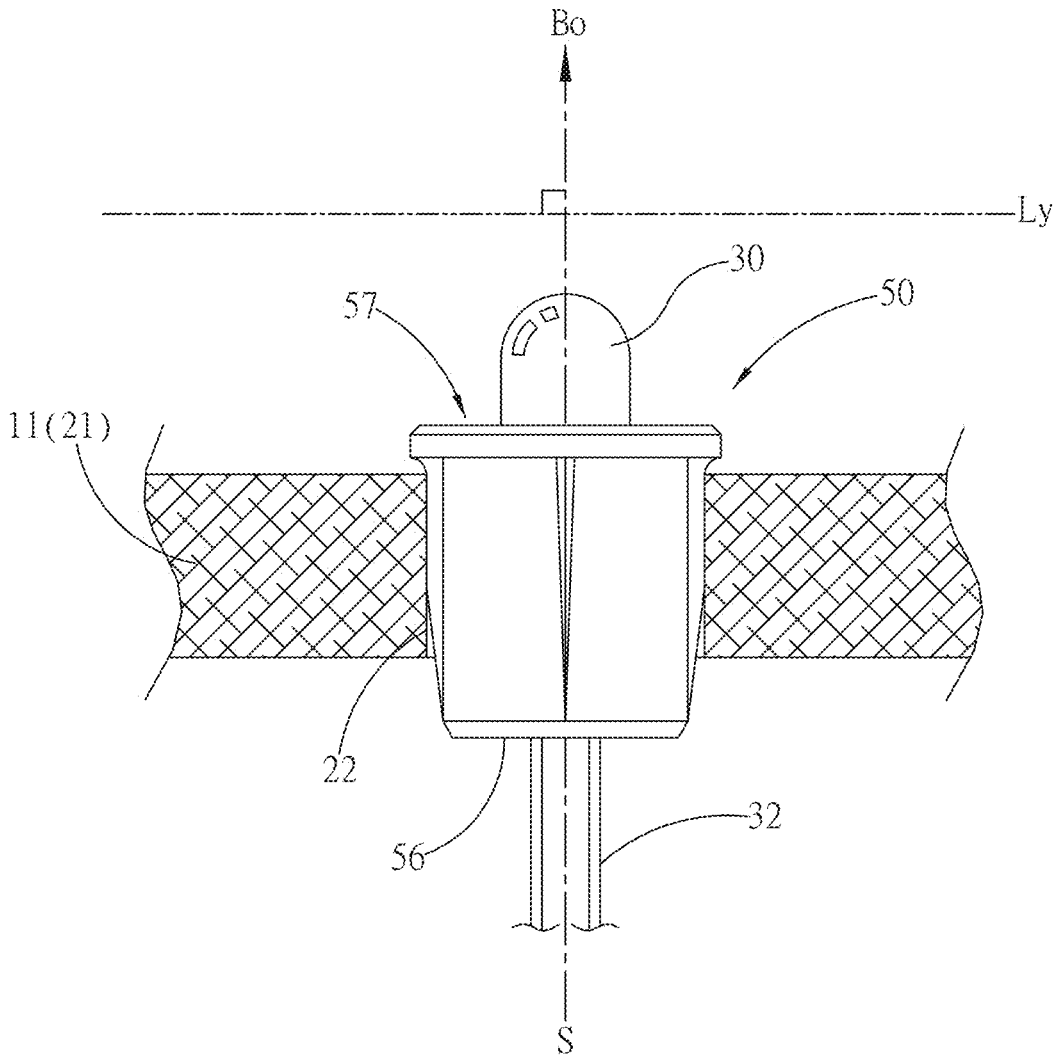
FIG. 11 shows a schematic view that a fixed transfer unit is assembled with the laser element, according to the present invention.
Figure 12:
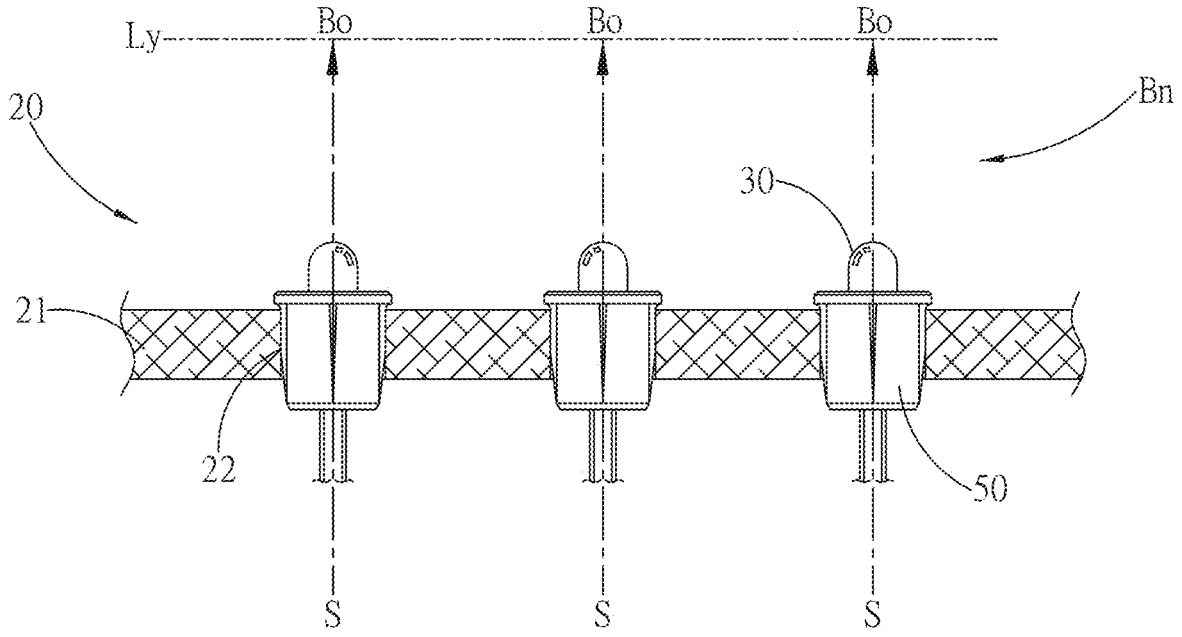
FIG. 12 shows a schematic view that plural light beams achieve a constant-height light emitting layer, according to the present invention.

Referring to FIG. 11 and FIG. 12, through combining the abovementioned transfer unit 50 with the drilled hole 22, the embedding slot 57 of the transfer unit 50 provides for latching in the laser element 30. After latching in the laser element 30, the input terminal 32 will penetrate a lower end of the root portion 56 to provide conduction electricity, and the light beams Bo generated from the laser elements 30 will be perpendicular to an optical plane Ly.

The implant area 21 in the illuminating area 20 is assembled with plural transfer units 50 through plural drilled holes 22, and the transfer unit 50 provides for assembling with the laser element 30. The light beams Bo generated from the laser elements 30 are superimposed on the center lines S, so that an equal lumen can be planned on the height of the optical plane Ly.

Figure 13:
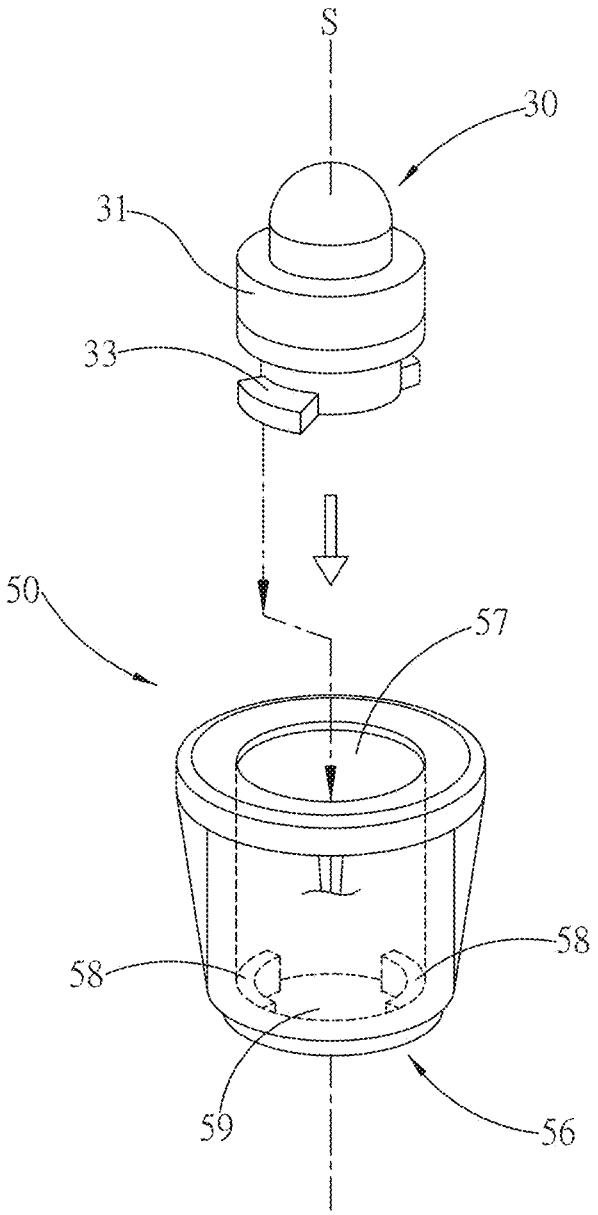
FIG. 13 shows a schematic view of implementation of a dry combination for the laser elements, according to the present invention.

Referring to FIG. 13, the embedding slot 57 of the transfer unit 50 provides for emplacing the laser element 30. The diameter of the base portion 31 of the laser element 30 is smaller than that of the embedding slot 57, and an off-center pinch plate 58 is disposed on the embedding slot 57 close to the root portion 56 against the center line S. A concentric opening 59 which penetrates axially is preserved between the pinch plates 58. This concentric opening 59 provides for axial penetration of an off-center wedge 33 at a lower end of the base portion 31. After penetrating the concentric opening 59, the off-center wedge 33 can rotate, and then the upper surface thereof is latched at the lower end of the pinch plate 58 to stabilize the positioning of the laser element 30. This method achieves a dry combination, facilitating the replacement of the laser element 30.

Figure 14:
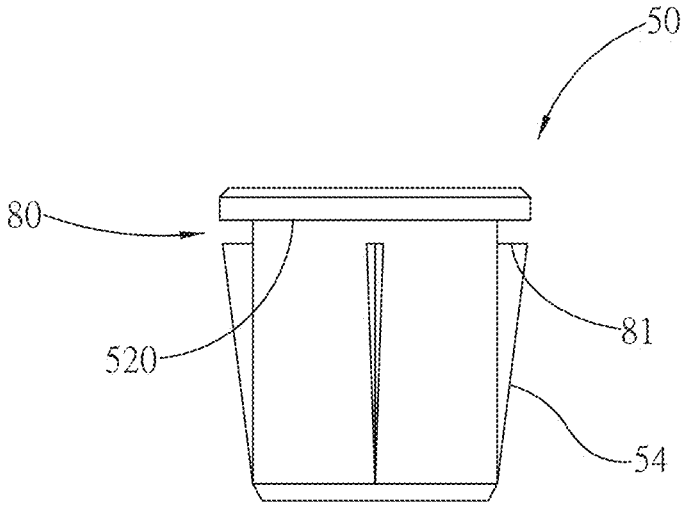
FIG. 14 shows a schematic view that a pitched fin is provided with a stress notch, according to the present invention.

Referring to FIG. 14, after assembling the transfer unit 50 as described above, the pitched fin 54 deforms gradually according to its slope. In the present invention, the joint location between the upper end of the pitched fin 54 and the corner end surface 520 is further concaved with a stress notch 80 to absorb the stress. A bottom of the stress notch 80 is an end edge 81 which connects with the upper end of the pitched fin 54, whereas an upper edge of the stress notch 80 is leveled with the corner end surface 520.

Figure 15:
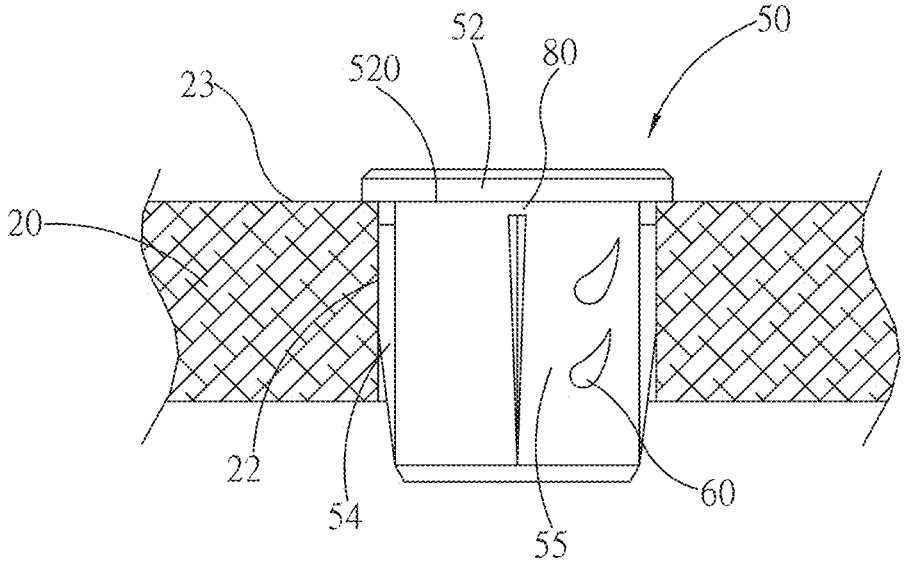
FIG. 15 shows a schematic view of operation of the stress notch, according to the present invention.

Referring to FIG. 15, the transfer unit 50 is sheathed into the drilled hole 22 of the illuminating area 20, and the pitched fin 54 squeezes gradually in an oblique direction to the inner circumference of the drilled hole 22 to form deformation. The force of deformation can satisfy the friction to the drilled hole 22, and with the existence of the stress notch 80, the pitched fin 54 can be deformed to reach the upper end; the body of the pitched fin 54 can be deformed freely due to the stress notch 80.

By the existence of the stress notch 80, when the transfer unit 50 is assembled with the drilled hole 22 to the limit, the corner end surface 520 can be attached flat on a rim 23 of the drilled hole 22. Before assembling, the adhesive agent 60 can be similarly injected into the adhesive tank 55, so that by the adhesive force, each element can be glued face to face. In addition, in the abovementioned combination, the deformation of the pitched fin 54 can be also plastic deformation depending upon the property thereof, which achieves a combination force of squeezing and friction as well.

Figure 16:
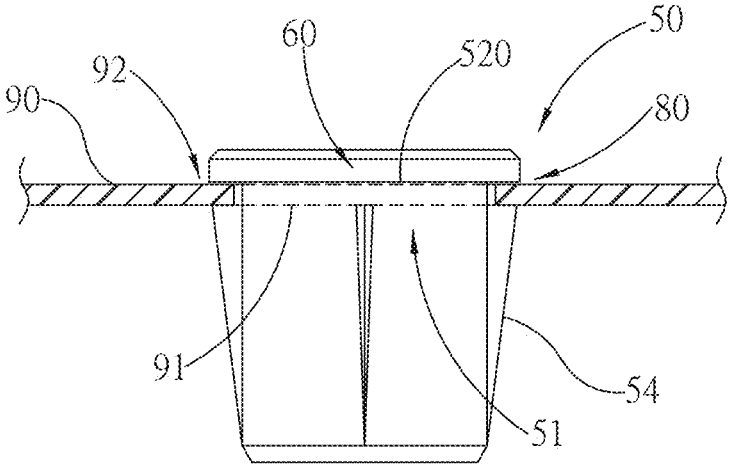
FIG. 16 shows a schematic view that the stress notch provides for combining with a thin shell unit, according to the present invention.

Referring to FIG. 16, the pitched fin 54 of the transfer unit 50 is provided with the stress notch 80. The stress notch 80 provides for sheathing a through-hole 91 provided by a thin shell unit 90. The thin shell unit 90 is thin and is made of plastic, so that the inner circumference of the through-hole 91 can have a force of elastic deformation and can utilize a plastic elastic strain due to the property of the pitched fin 54. By the abovementioned elastic effect, in assembling the pitched fin 54 with the through-hole 91, the two will be deformed elastically. Finally, the through-hole 91 will cut into the stress notch 80 elastically, and the transfer unit 50 cannot withdraw after assembling.

Before assembling, the joint location between the corner end surface 520 and the barrel unit 51 can be filled with the adhesive agent 60 in advance. Therefore, after assembling, the corner end surface 520 of the transfer unit 50 is abutted on the rim 92 of the through-hole 91. After the adhesive agent 60 is solidified, a shaping connection is achieved.

Figure 17:
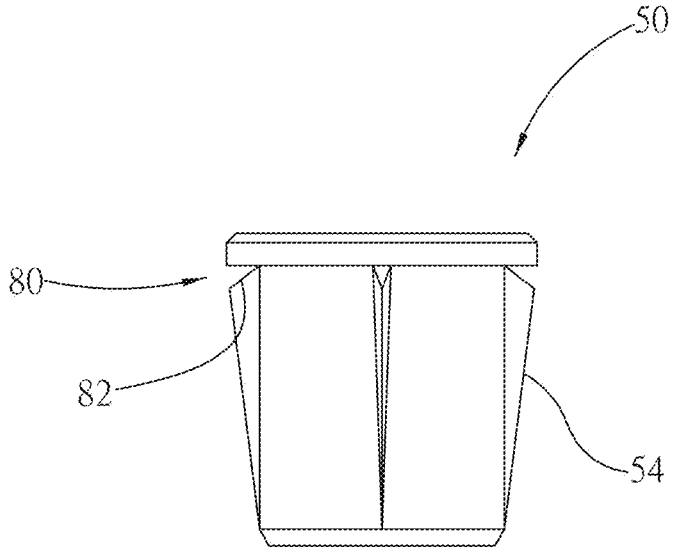
FIG. 17 shows a schematic view that the stress notch is provided with an oblique end edge, according to the present invention.

Referring to FIG. 17, the connection between the stress notch 80 and the pitched fin 54 of the transfer unit 50 can be implemented by connecting an oblique end edge 82 which is indented upward. Therefore, within the limit of opening, the through-hole 91 of the thin shell unit 90 in a various thickness (as shown in FIG. 16) can be pinched.

The present invention discloses an adapting type of optical element for a shell-like accessory, which provides for a light emitting area of a large doll, so that projected angles of light beams from laser elements can be accurate by adapting transfer units, of which the angles are pre-adjusted, to the laser elements. The transfer unit is distributed equiangularly with plural pitched fins in a same shape along a radial direction on the outer circumference. The pitched fin can be cut into the inner circumference of the drilled hole in the implant area to be combined in dry. In addition, the adhesive tank between the pitched fins can be filled with the adhesive agent, and before the adhesive agent is solidified, the isometric torus of each transfer unit can be adjusted to align flat, with the center line thereof being parallel to each other. Therefore, the light beams of the post-installed laser elements can be parallel to one another, allowing the appearance of the illuminating area to have a beautified effect in vision with the uniform lumen, which is a brand new design in the realm of shell-like accessory.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An adapting type of optical element for a shell-like accessory, the shell-like accessory being formed by gluing fiber threads, and having a selected implant area of an illuminating area on a surface of the shell-like accessory, the surface being provided with plural drilled holes in equal diameter being distributed in an array and drilled axially on a surface of the implant area, the adapting type of optical element comprising:

a barrel-shaped transfer unit having a center line, a lower end, an upper end surface and an embedding slot, a diameter of the barrel-shaped transfer unit being smaller than that of a drilled hole on the surface of the shell-like accessory, the lower end of the barrel-shaped transfer unit being a root portion, the upper end surface of the barrel-shaped transfer unit being expanded with a ring spoke, an upper end surface of the ring spoke being connected inward with the embedding slot along the center line, an outer circumference of the barrel-shaped transfer unit being distributed radially with three pitched fins in a same shape radially extending away from the center line, each of the pitched fins using a longitudinal line on an outer surface of the barrel-shaped transfer unit as a thigh edge, a corner end surface of each pitched fin connected with the ring spoke as a hook edge, and a chord edge constructing a triangle which is combined integrally on the surface of the barrel-shaped transfer unit and a surface of the corner end surface, wherein the barrel-shaped transfer unit is configured to be fixed and combined with an illuminating area planned on the surface of the shell-like accessory.

2. The adapting type of optical element for a shell-like accessory, according to claim 1, wherein the embedding slot provides for installing a laser element which is latched in along the center line, and an input terminal provided by the laser element penetrates an outer end of the root portion axially.

3. The adapting type of optical element for a shell-like accessory, according to claim 1, wherein a root portion of the laser element is radially provided with an off-center wedge, and a bottom of the embedding slot of the barrel-shaped transfer unit is provided correspondingly with a concentric opening to transfix the off-center wedge and a pinch plate to pinch the off-center wedge.

4. The adapting type of optical element for a shell-like accessory, according to claim 1, wherein a surface of the barrel-shaped transfer unit is provided with an adhesive tank which is disposed in a space between two pitched fins.

5. The adapting type of optical element for a shell-like accessory, according to claim 1, wherein a structural strength of each pitched fin of the barrel-shaped transfer unit is larger than a tissue strength of the implant area.

6. The adapting type of optical element for a shell-like accessory, according to claim 1, wherein a tissue strength of the illuminating area is larger than a structural strength of each pitched fin of the barrel-shaped transfer unit.

7. The adapting type of optical element for a shell-like accessory, according to claim 1, wherein the drilled holes are distributed in an array, and the pitches of the drilled holes change in a geometric series.

8. The adapting type of optical element for a shell-like accessory, according to claim 1, wherein each pitched fin is a rib, and a transversal cross section of each pitched fin is a triangle.

9. The adapting type of optical element for a shell-like accessory, according to claim 1, wherein the upper end surface of the ring spoke is an isometric torus.

10. The adapting type of optical element for a shell-like accessory, according to claim 1, wherein the barrel-shaped transfer unit is formed of a hot-work molded plastic material.

11. The adapting type of optical element for a shell-like accessory, according to claim 1, wherein a joint location between an upper end of each pitched fin and the corner end surface is provided with a stress notch, and an upper edge of the stress notch is leveled with the corner end surface.

12. The adapting type of optical element for a shell-like accessory, according to claim 11, wherein the stress notch is connected with a corresponding pitched fin through an oblique end edge.

* * * * *